US011406176B2

(12) United States Patent
Dudley

(10) Patent No.: US 11,406,176 B2
(45) Date of Patent: Aug. 9, 2022

(54) FOLDABLE TOOTHBRUSH WITH CARABINER

(71) Applicant: 3D HOLDING COMPANY, LLC, Scottsdale, AZ (US)

(72) Inventor: Calvin Dudley, Lynchburg, VA (US)

(73) Assignee: 3D HOLDING COMPANY, LLC, Scottsdale, AZ (US)

( * ) Notice: Subject to any disclaimer, the term of this patent is extended or adjusted under 35 U.S.C. 154(b) by 0 days.

(21) Appl. No.: 17/174,639

(22) Filed: Feb. 12, 2021

(65) Prior Publication Data

US 2021/0186202 A1 Jun. 24, 2021

Related U.S. Application Data

(63) Continuation of application No. 16/647,156, filed as application No. PCT/US2018/050851 on Sep. 13, 2018, now Pat. No. 10,918,200.

(Continued)

(51) Int. Cl.
*A46B 15/00* (2006.01)
*A46B 5/00* (2006.01)

(Continued)

(52) U.S. Cl.
CPC ..... *A46B 15/0097* (2013.01); *A46B 5/002* (2013.01); *A46B 5/0041* (2013.01); *A46B 5/0058* (2013.01); *A46B 9/04* (2013.01); *A46B 17/04* (2013.01); *A46B 17/08* (2013.01); *A46B 2200/1066* (2013.01)

(58) Field of Classification Search
CPC ..... A46B 9/04; A46B 5/002; A46B 5/0033; A46B 5/0041; A46B 5/0058; A46B 15/0097; A46B 17/02; A46B 17/04; A46B 17/08; A46B 2200/1066
See application file for complete search history.

(56) References Cited

U.S. PATENT DOCUMENTS 1,206,010 A 11/1916 Mackeever
1,289,171 A 12/1918 Hilton (Continued)

FOREIGN PATENT DOCUMENTS

CN 202750936 U 2/2013
CN 205513132 U 8/2016

(Continued)

OTHER PUBLICATIONS

International Search Report and Written Opinion dated Nov. 9, 2018 in related/corresponding International Application No. PCT/US2018/050851.

*Primary Examiner* — Randall E Chin
(74) *Attorney, Agent, or Firm* — Patent Portfolio Builders PLLC

(57) ABSTRACT

A toothbrush including bristles extended from one end of the toothbrush, a handle extended from another end of the toothbrush opposite the one end, and any of an attachment hole, arranged between the bristles and handle and configured to receive a support leg to be attached therein, and a groove are provided, either of which may improve drying and therefore decrease in transmission of pathogens via the bristles by, for example, improving air circulation to the bristles raised away from a surface via action of the end and the surface.

9 Claims, 23 Drawing Sheets

Related U.S. Application Data

(60) Provisional application No. 62/681,846, filed on Jun. 7, 2018, provisional application No. 62/578,737, filed on Oct. 30, 2017, provisional application No. 62/558,541, filed on Sep. 14, 2017.

(51) Int. Cl.

| | |
|---|---|
| ***A46B 9/04*** | (2006.01) |
| ***A46B 17/08*** | (2006.01) |
| ***A46B 17/04*** | (2006.01) |

(56) References Cited

U.S. PATENT DOCUMENTS

| | | | | |
|---|---|---|---|---|
| 1,328,162 | A | 1/1920 | Hecht | |
| 1,899,242 | A | 2/1933 | Alexander | |
| 2,938,224 | A | 5/1960 | Foulkes | |
| 3,132,834 | A | 5/1964 | Adams | |
| 3,231,919 | A | 2/1966 | Macdonald | |
| 3,612,464 | A | 10/1971 | Harrah | |
| 5,406,668 | A | 4/1995 | Goodhue | |
| 5,636,904 | A | 6/1997 | Bell et al. | |
| 5,809,608 | A | 9/1998 | Zadro | |
| 7,246,400 | B2 | 7/2007 | Ryan | |
| 2003/0000037 | A1 | 1/2003 | Carr et al. | |
| 2003/0196296 | A1 | 10/2003 | Sonne | |
| 2005/0183904 | A1* | 8/2005 | Bacalso | A63B 29/08 182/5 |
| 2006/0070197 | A1 | 4/2006 | May et al. | |
| 2009/0193599 | A1 | 8/2009 | Stein et al. | |
| 2013/0333131 | A1* | 12/2013 | McCarthy | A46B 15/0095 15/159.1 |
| 2014/0304929 | A1 | 10/2014 | Rechtin et al. | |
| 2014/0331429 | A1 | 11/2014 | Lim | |
| 2016/0296003 | A1 | 10/2016 | Beckerman et al. | |
| 2017/0203609 | A1 | 7/2017 | Haskins et al. | |
| 2017/0332772 | A1* | 11/2017 | Davis | A46B 5/005 |
| 2021/0307497 | A1* | 10/2021 | Patterson | A46B 15/0097 |

FOREIGN PATENT DOCUMENTS

| | | | |
|---|---|---|---|
| DE | 29611995 | U1 | 10/1996 |
| JP | 2000511456 | A | 9/2000 |
| JP | 2013085754 | A | 5/2013 |
| KR | 200273487 | Y1 | 4/2002 |
| WO | 2014073878 | A1 | 5/2014 |

* cited by examiner

FOLDABLE TOOTHBRUSH WITH CARABINER

CROSS-REFERENCE TO RELATED APPLICATIONS

This application claims priority to and the benefit of U.S. Provisional Patent Application No. 62/558,541, filed on Sep. 14, 2017, U.S. Provisional Patent Application No. 62/578,737, filed on Oct. 30, 2017, U.S. Provisional Patent Application No. 62/681,846, filed on Jun. 7, 2018, International PCT Patent Application PCT/US18/50851, filed on Sep. 13, 2018, and U.S. Non-Provisional patent application Ser. No. 16/647,156, filed on Mar. 13, 2020, now U.S. Pat. No. 10,918,200, the disclosures of which are incorporated by reference herein in their entirety.

BACKGROUND

Much has been written about the billions of bacteria on toothbrushes, with two of the common messages being problems are caused by: 1) storing a toothbrush flat, e.g., on the surface of a sink, or covering it so that the bristles are not allowed to dry; and 2) storing toothbrushes upright in a shared container.

Many studies clearly state that all of the presently available toothbrushes have the ability to be infected by a wide range of microorganisms, including viruses which can cause the common cold to even herpes. Pneumonia-causing bacteria also are found on a toothbrush.

Accordingly, it would be desirable to provide new toothbrush designs which avoid or mitigate the afore-mentioned problems.

SUMMARY

There is described herein a toothbrush including bristles extended from one end of the toothbrush, a handle extended from another end of the toothbrush opposite the one end and an attachment hole arranged between the bristles and handle and configured to receive a support leg to be attached therein.

There is described a toothbrush further including the support leg attached to the attachment hole such that the support leg is configured to rotate about the attachment hole and away from an axial direction from the bristles to the handle, and the support leg includes a groove and an end.

There is described a toothbrush further including the support leg which configured to rotate from the axial direction such that the attachment hole acts as a hinge and such that a surface of the handle and the end of the support leg each simultaneously lie flatly against a table while the bristles are maintained in an upright position away from the surface.

There is described a toothbrush further including the groove which is configured to attach to a rim of a cup in a state in which the support leg is extended from the axial direction, and in a case in which the groove is attached to the rim of the cup, a second surface of the handle lies flatly against a side of the cup while the groove and the second surface maintain the bristles in an upright position away from the cup, and the surface and the second surface are angled differently from each other along the axial direction.

There is described a toothbrush further including the groove which is configured to attach to a rim of a cup in a state in which the support leg is extended from the axial direction, and in a case in which the groove is attached to the rim of the cup, a surface of the handle lies flatly against a side of the cup while the groove and the surface maintain the bristles in an upright position away from the cup.

There is described a toothbrush further including the support leg which is further configured to rotate, via the attachment hole as a hinge, to a state in which the support leg is flatly arranged from the handle towards the bristles, and a portion of a body of the toothbrush extends between the support leg in the axial direction in such state.

There is described a toothbrush further including the attachment hole which includes an attachment groove, and wherein the support leg is further configured to rotate, via the attachment groove as a hinge, to a state in which the support leg is flatly arranged from the handle towards the bristles, and along a length of the support leg, portions of a body of the toothbrush extends along outsides of the length of the support leg in the axial direction in such state.

There is described a toothbrush further including a bristle cover, and a groove track in the handle and configured to receive an attachment of the bristle cover therein via a retention ball of the bristle cover extended through the groove track in the axial direction.

There is described a toothbrush further including a second attachment hole, opposite the attachment hole in a direction perpendicular to the axial direction, and a second support leg attached to the second attachment hole and configured to rotate about the second attachment hole along with a rotation of the support leg via the attachment hole, and the second support leg is configured to maintain the bristles in an upright position away from a surface in contact with any of the support leg and the second support leg in a state in which any of the support leg and the second support leg contact the surface.

There is described a toothbrush further including a tongue scrubber arranged opposite the bristles in a direction perpendicular to the axial direction.

There is described a toothbrush further including the support leg and the handle each which comprise a plurality of hollow cavities extended therethrough.

There is described a toothbrush further including bristles extended from one end of the toothbrush, a handle extended from another end of the toothbrush opposite the one end, and in an axial direction from the bristles to the handle, a groove configured to attach the toothbrush to an edge of an object such that the bristles are extended away from any surface to which the groove is attached.

There is described a toothbrush further including a tongue scrubber attached opposite to the bristles in a direction perpendicular to the axial direction, a plurality of finger grips arranged at opposite sides of the toothbrush in the direction and also at opposite sides of the groove in the axial direction, and a rubber grip at the handle configured to counterbalance, with the handle, the toothbrush in a state in which the groove is attached to the edge of the object.

There is described a toothbrush further including the groove extends along a length of the handle in the axial direction and includes a plurality of side grippers configured to, in a state in which the groove is attached to the edge of the object, grip inner and outer surfaces of the object respective.

DETAILED DESCRIPTION

In the following discussion, descriptions of well-known functions and constructions are omitted for increased clarity and conciseness.

Figure 1:
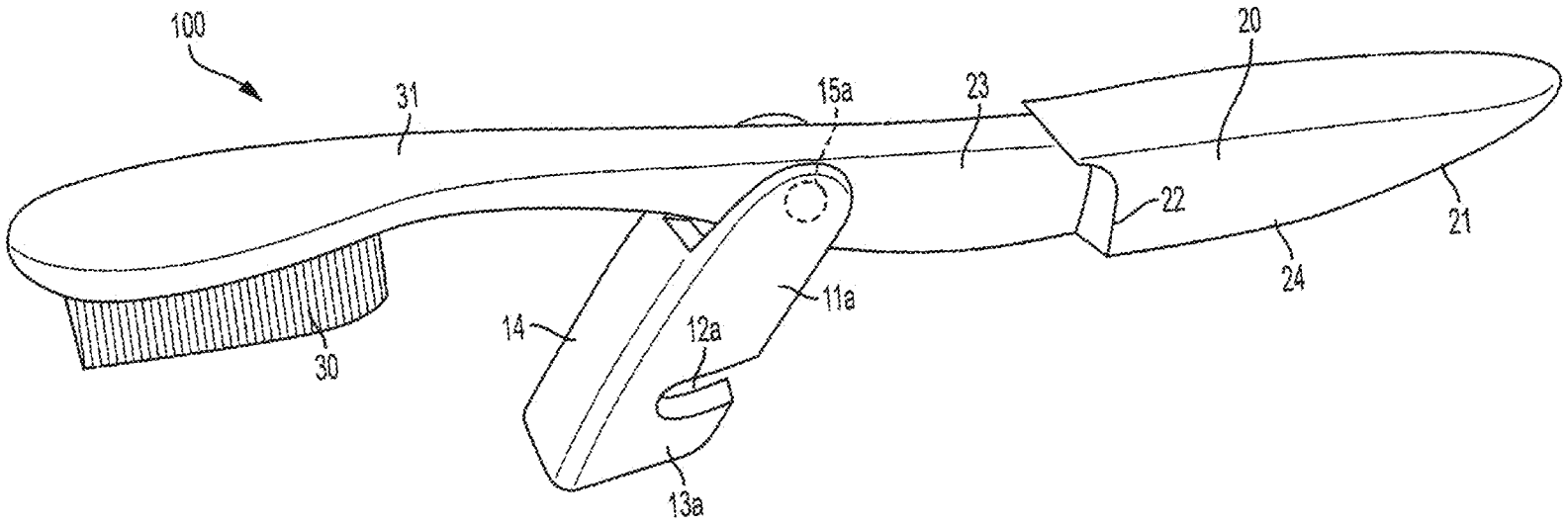
FIG. 1 shows a unibody support leg with the leg extended.

FIG. 1 illustrates a toothbrush 100. The toothbrush 100 includes a unibody support leg 14 attached thereto via an attachment 15*a*, described in detail below. The toothbrush 100 further includes bristles 30, a neck 31, a body 23, and a handle 20.

The handle 20 includes a surface 24 and a surface 21 inclined at different angles. As in FIG. 1, the surface 21 is flat to another surface, such as a table or the like, whereas the surface 24 is angled away from the surface which will be described in greater detail below, such as with FIG. 2.

The handle 20 transitions to the body 23 by a rear stopper 22 into which the unibody support leg 14, which is extended in FIG. 1, is configured to rotate into via an attachment at attachment 15*a*. The position of the support leg in FIG. 1 is sometimes referred to herein as the "support position" of support leg 14. As such, the unibody support leg 14 may be flatly placed along the body 23 and handle 20 portions, such as in FIG. 3, this being referred to herein in some places as the "closed position" of the support leg 14.

The unibody support leg 14 may act as a stand, along with the surface 21, by pressing an end 13*a* of the unibody support leg 14 such that the bristles 30 are raised away from any surface on which the surface 21 may be arranged. Thus, in the configuration of FIG. 1, the action of the unibody support leg 14 and the surface 21 act to improve drying and therefore decrease in transmission of pathogens via the bristles 30 by, for example, improving air circulation to the bristles 30 raised away from a surface via action of the end 13*a* and the surface 21.

Figure 2:
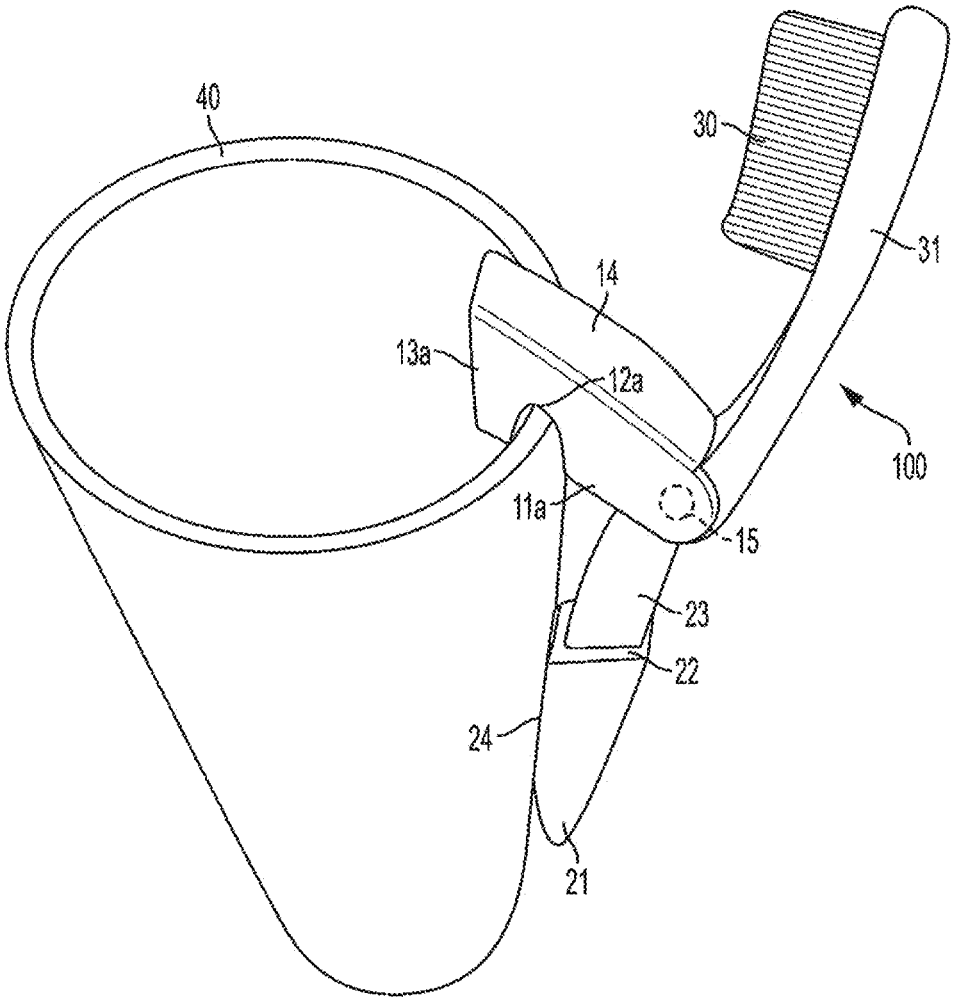
FIG. 2 shows a unibody support leg with a hook cavity for hanging.

Further, the unibody support leg 14 includes a leg 11*a* extended from an attachment 15*a* at the body 23 to a hook 12*a* described with respect to FIG. 2 for example.

Figure 5:
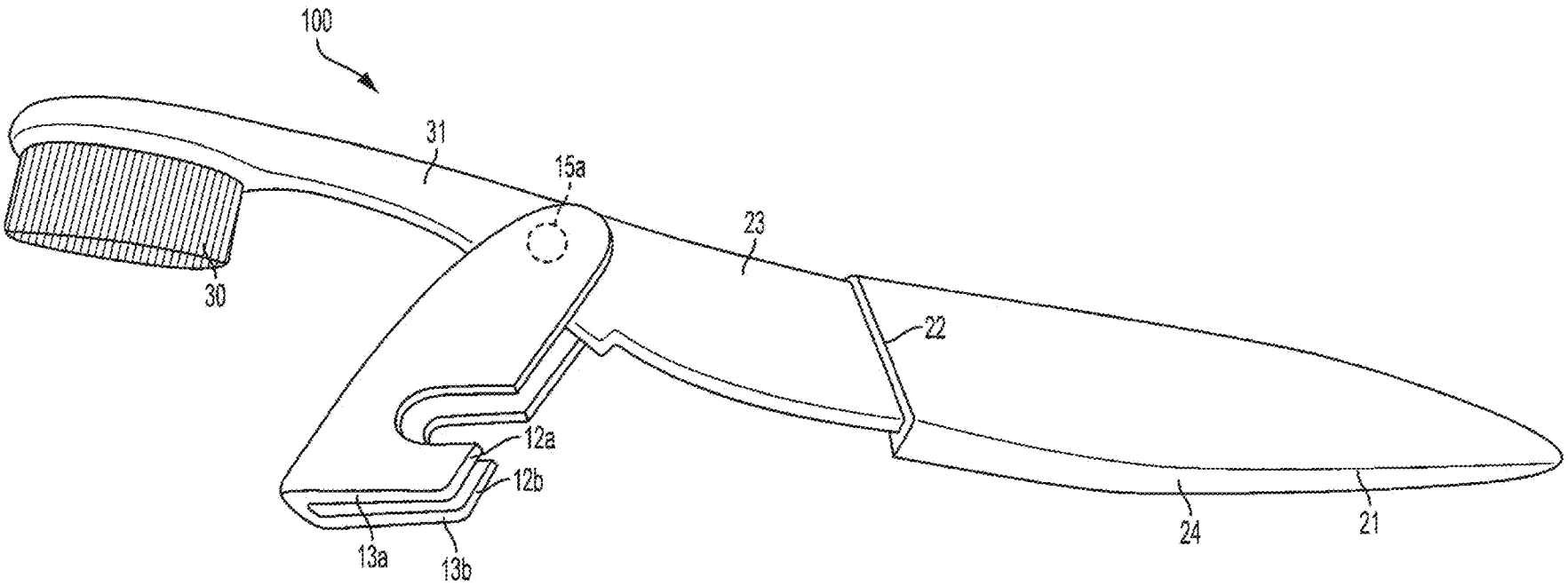
FIG. 5 shows a unibody support leg with a hook that folds flat into the handle on both sides and bottom when in use or storage.

As better illustrated in FIG. 5, the unibody support leg 14 may form a U-shape, such as via the end 13*a* and end 13*b* that fits flat onto a surface.

When the support leg 15 is deployed in the support position, the toothbrush 100 can be rested on a flat surface as shown in FIG. 1 in a manner such that the bristles do not touch the flat surface. Alternatively, when support leg 15 is deployed in the support position, the toothbrush 100 can be hung from a vertical surface. For example, FIG. 2 illustrates the toothbrush 100 in a configuration in which the surface 24 and the unibody support leg 14 act against a body, such as a cup 40 or the like, via the hook 12*a* latching to an edge of the cup 40. As such, in this configuration, the bristles 30 of the toothbrush 100 remain in a state in which increased airflow may be maintained while also extending the bristles 30 away from the cup 40 such that, for example, other toothbrushes with similar or alternate configurations may also be arranged. That is, the bristles 30 of the toothbrush 100 would be maintained away from other bristles of other toothbrushes via a curvature of the neck 31 and action of the unibody support leg 14 and surface 24 with respect to the cup 40.

In view of FIGS. 1 and 2, the bristles 30 may drip dry in either configuration, both vertically and horizontally.

Figure 3:
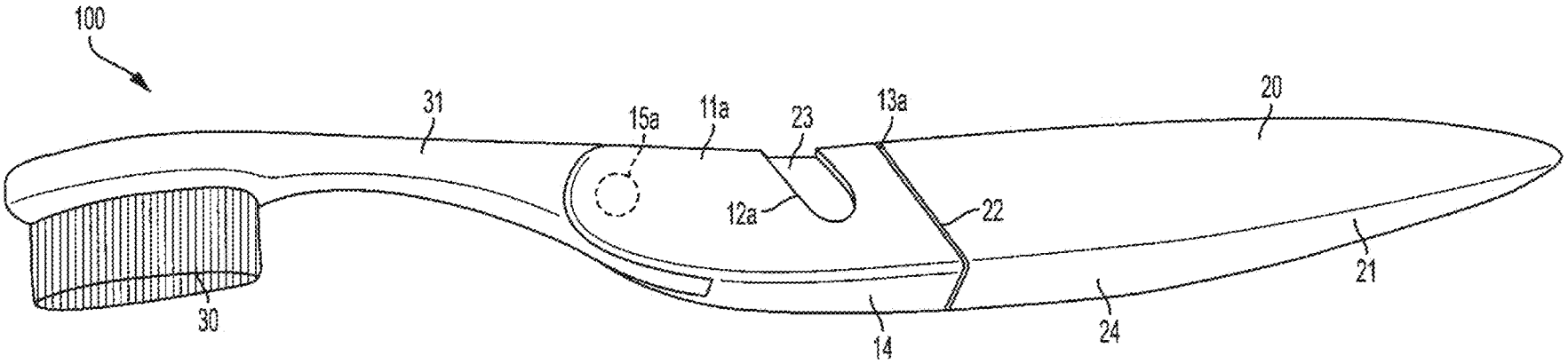
FIG. 3 shows a unibody support leg with a hook that folds flat into a handle on both sides and a bottom when in use or storage.

FIG. 3 illustrates the toothbrush 100 in a configuration in which the unibody support leg 14 is folded, via pressure applied the unibody support leg 14 to rotate about the attachment 15*a*, flat into the body 23 and the handle 20 such that the end 13*a* of the unibody support leg 14 abut flatly the rear stopper 22 of the handle 20. The unibody support leg 14 may be retracted via a thumb being drawn back into a palm of a hand or the like.

Figure 7D:
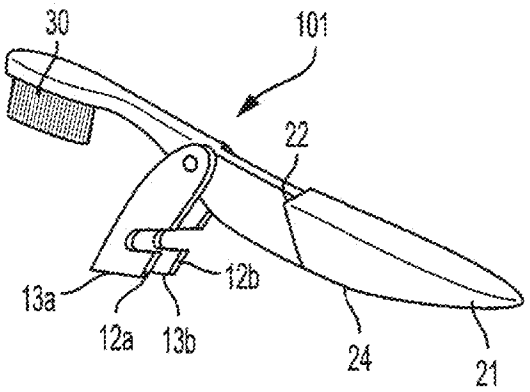
FIGS. 7A-7D show front, rear and side views of a toothbrush with an extended leg.
Figure 7C:
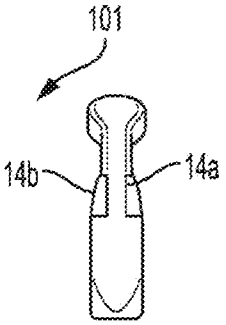

The leg 11*a* and the end 13*a* also may extend along an inner surface of the body 23 on both sides of the toothbrush 100 as illustrated, for example, in FIG. 7C. As such, in FIG. 3, the unibody support leg 14 with the end 13*a* may fold flat into the handle 20 on both sides and a bottom of the toothbrush 100 when in use or storage.

Figure 4:
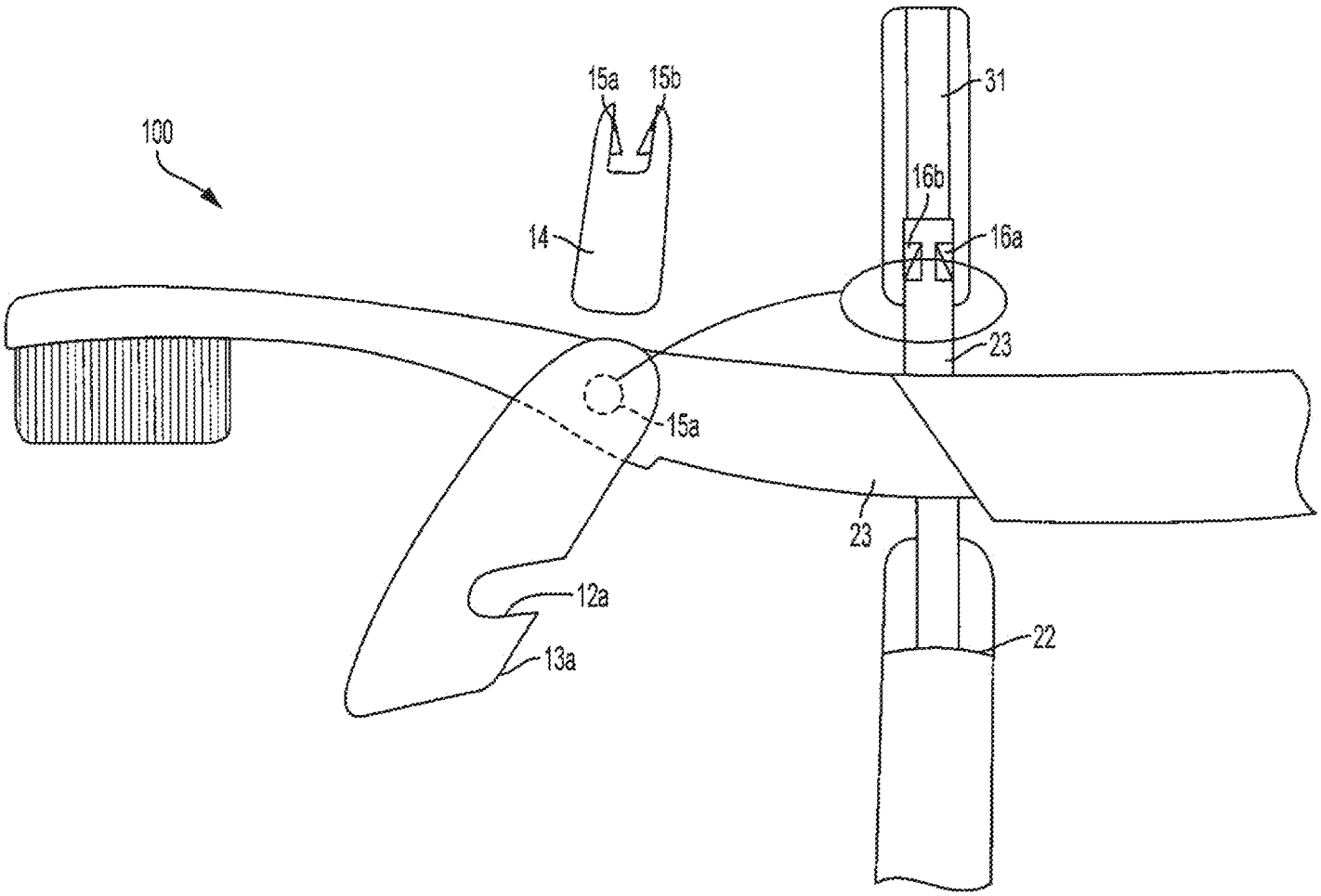
FIG. 4 shows a unibody support leg attaching to a toothbrush.

FIG. 4 illustrates a front view of the unibody support leg 14 of the toothbrush 100. As illustrated in FIG. 4, the unibody support leg 14 is shown with attachment 15*a* and attachment 15*b* therein which attached to hole 16*a* and hole 16*b* of the body 23. The attachment may be via wedge clips snapping into sides of the holes 16*a* and 16*b* or the like. However those skilled in the art will appreciate that any desired support connection can be used to connect the support leg 14 to the body 23. For example, pins could be formed in the body 23 to mate with holes in the support leg 14. Alternatively, support leg 14 could be formed integrally with body 23.

FIG. 5 illustrates a side view of the toothbrush 100 in which both end 13*a* and end 13*b* are illustrated and hook 12*a* and hook 12*b* are also illustrated which each may extend from and around respective sides of the body 23.

Figure 6:
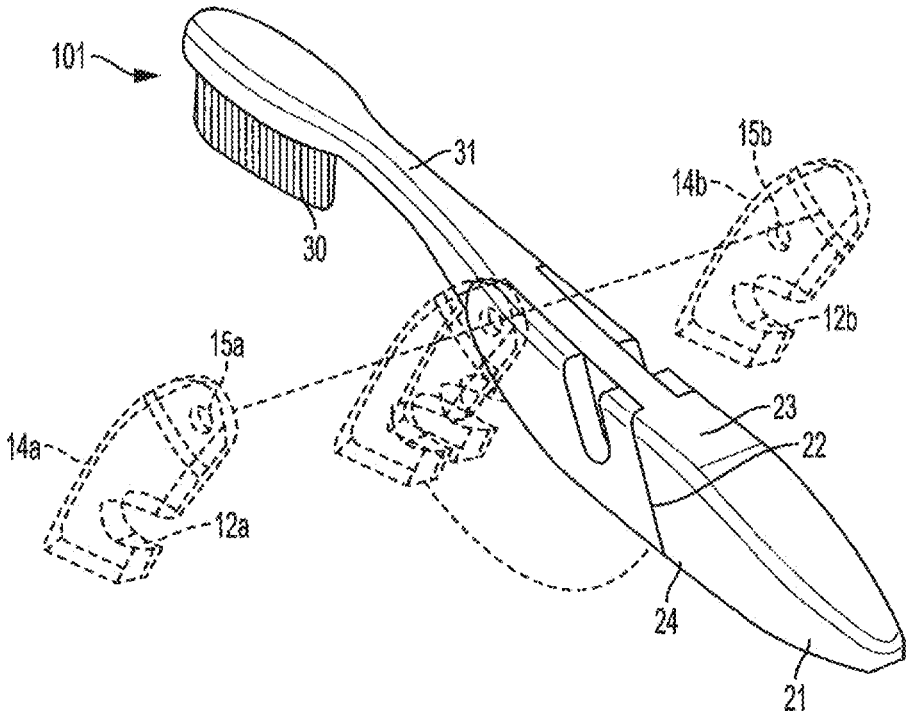
FIG. 6 shows a support legs attaching to a toothbrush.

FIG. 6 illustrates a toothbrush 101, similar to the toothbrush 100, whereas instead of a unibody support leg 14 instead the toothbrush 101 may instead attach to respective support leg 14*a* and support leg 14*b* via attachment 15*a* and attachment 15*b* in a substantially similar manner as with the toothbrush 100. The support leg 14*a* and the support leg 14*b* may rotate separately or simultaneously via action of the attachment 15*a* and attachment 15*b* against the toothbrush 101.

The support leg 14*a* is illustration in addition with a hook 12*a*, and the support leg 14*b* is illustrated in addition with a hook 12*b*. The hook 12*a* and the hook 12*b* of the support leg 14*a* and the support leg 14*b* may act against an object, such as cup 40, in a similar manner as discussed with respect to the toothbrush 100 of FIG. 2.

Figure 7B:
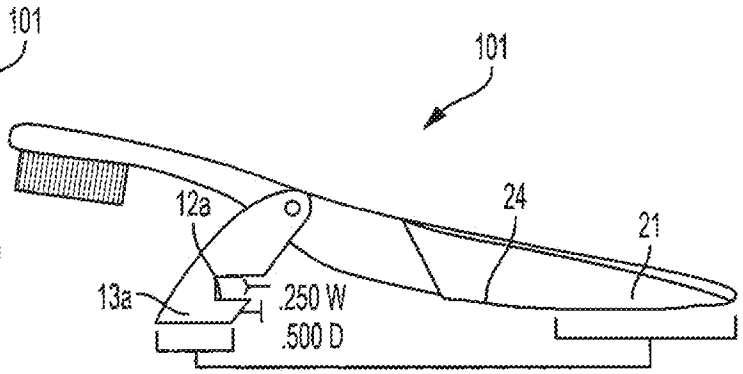
Figure 7A:
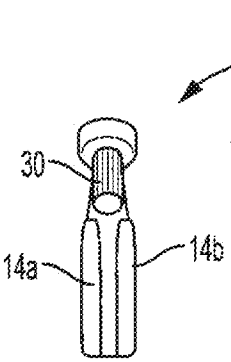

FIG. 7A illustrates the toothbrush 101 from a front view with extended leg 14*a* and extended leg 14*b*.

FIG. 7B illustrates a side view of the toothbrush 101 in a drip dry vertical position. As illustrated in FIG. 7B, the surface 21 and the end 13*a* may make a total contact area of 0.85 square inches.

The hook 12*a* may have a width therein of 0.250 inches and a distance between the hook 12*a* and the end 13*a* may be 0.500 inches. The support leg 14*a* and the support leg 14*b* may fold flatly into the sides and bottom of the toothbrush 101 similar to the unibody support leg 14 of the toothbrush 100.

FIG. 7C illustrates the toothbrush 101 from a rear view with extended leg 14*a* and extended leg 14*b*.

FIG. 7D illustrates a side view of the toothbrush 101 in a drip dry vertical position. As illustrated in FIG. 7D, the surface 21 and the end 13*a* may make a total contact area of 0.85 square inches.

Each of the hook 12*a* and hook 12*b* may have a width therein of 0.250 inches and a distance between each of the hooks 12*a* and hook 12*b* and respective ones of the end 13*a* and the end 13*b* may be 0.500 inches. The support leg 14*a* and the support leg 14*b* may fold flatly into the sides and bottom of the toothbrush 101 similar to the unibody support leg 14 of the toothbrush 100.

Figure 8A:
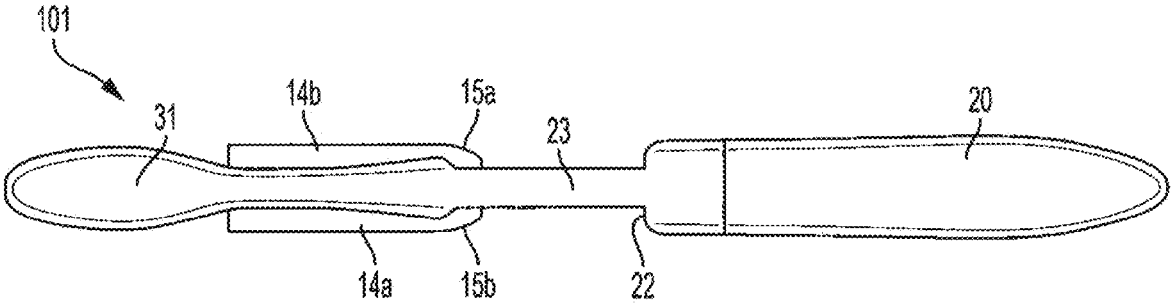
FIGS. 8A and 8B show top and bottom views of a toothbrush with an extended leg.
Figure 8B:
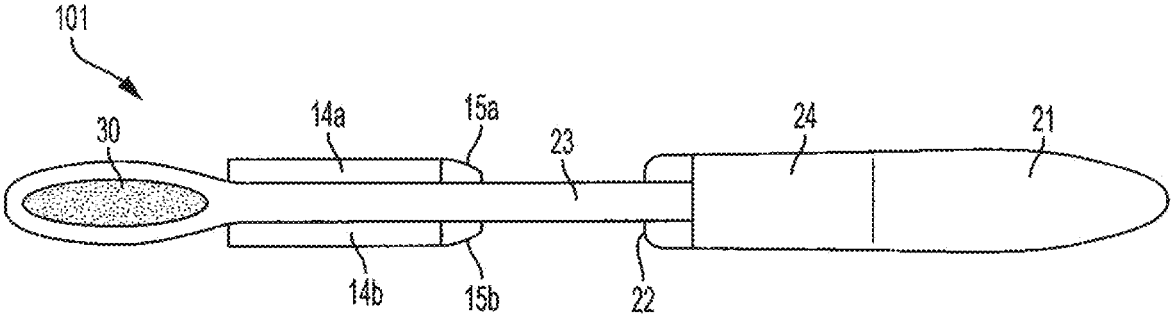

FIG. 8*a* illustrates a top view of the toothbrush 101 with the support leg 14*a* and the support leg 14*b* extended, and FIG. 8*b* illustrates a bottom view of the toothbrush 101 with the support leg 14*a* and the support leg 14*b* extended.

Figure 9:
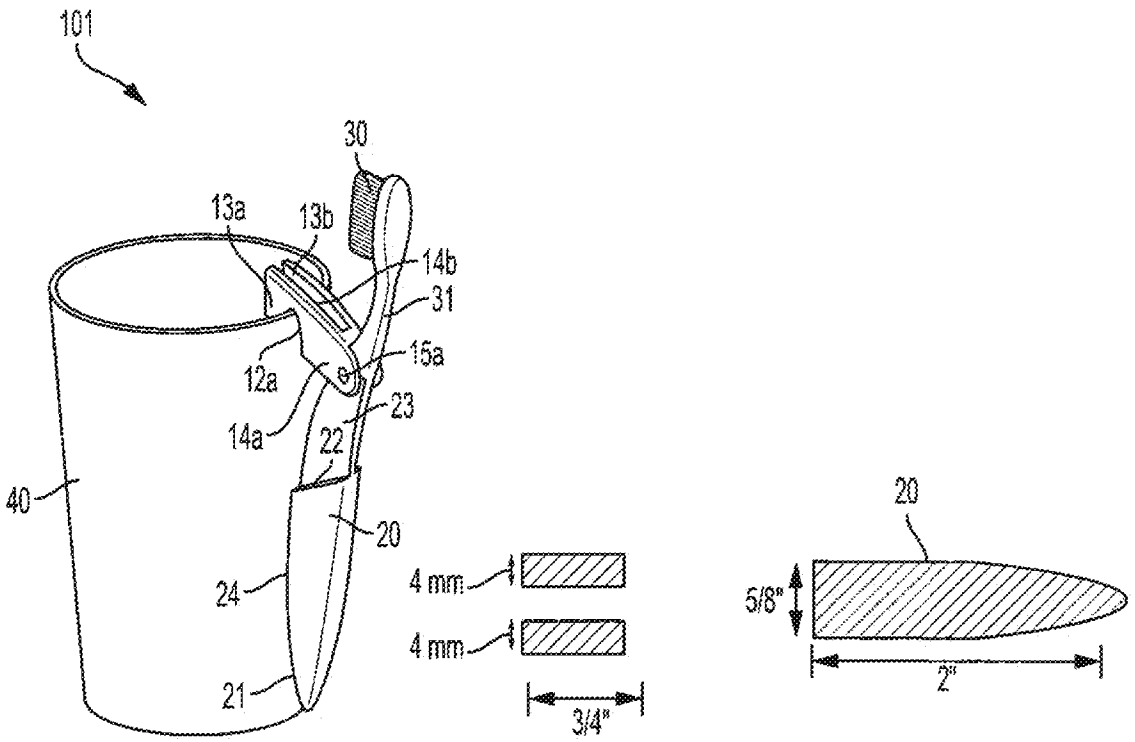
FIG. 9 shows a support leg with a hook cavity for hanging.

FIG. 9 illustrates a modification of FIG. 2 in which the toothbrush 101 with the support leg 14*a* and support leg 14*b* illustrated instead. A total surface area made by the handle 20 against the cup 40 may be 0.67 square inches. The handle 20 may have a width of 0.675 inches and a length of 2 inches. A total surface area made by the support leg 14*a* and support leg 14*b* may be 0.09 square inches each against the cup 40. Each of the support leg 14*a* and support leg 14*b* may have a width of equal to or approximately 0.0.16 inches and a length of 0.75 inches.

Similar to FIG. 2, in this configuration of FIG. 9, the bristles 30 of the toothbrush 101 remain in a state in which increased airflow may be maintained while also extending the bristles 30 away from the cup 40 such that, for example, other toothbrushes with similar or alternate configurations may also be arranged. That is, the bristles 30 of the toothbrush 100 would be maintained away from other bristles of other toothbrushes via a curvature of the neck 31 and action of the support legs 14*a* and 14*b* and the surface 24 with respect to the cup 40.

Figure 10A:
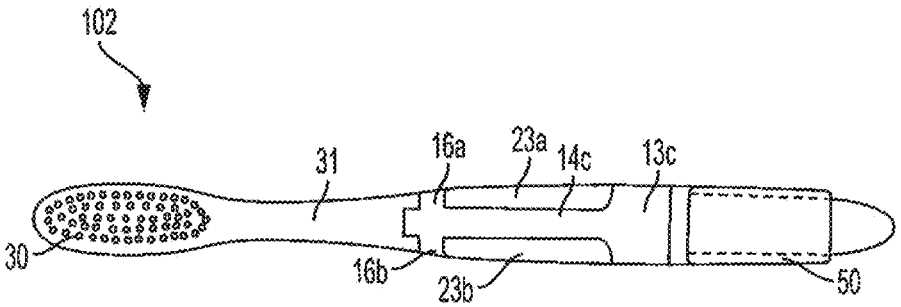
FIGS. 10A, 10B and 11-16 show embodiments including modifications.
Figure 10B:
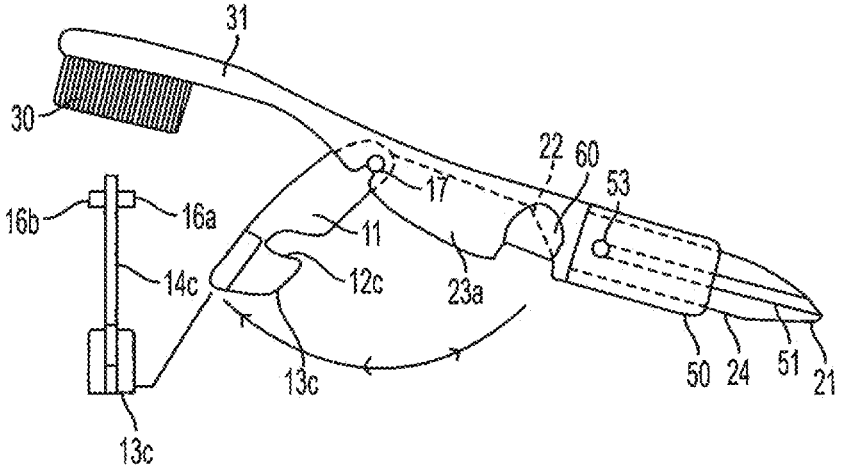

FIGS. 10A and 10B illustrate a toothbrush 102 similar to the toothbrushes 100 and 101 in that the toothbrush 102 includes bristles 30, a neck 31 and surfaces 24 and 21. However, instead of the support legs as with the toothbrushes 100 and 101, the toothbrush 102 instead includes a modification in which a support leg 14*c* may be provided with attachments 16*a* and 16*b* inserted into a groove 17 at the neck 31 of the toothbrush 102.

The support leg 14*c* may rotate about the groove 17 from a position flatly arranged in between body walls 23*a* and 23*b* and a thumb handle 60 to a position extended such that the surface 24 and the end 13*c* may position the toothbrush 102 in an upright drying position, such as in FIG. 1.

The support leg 14*c* may be extended via pressing a thumb, or the like, against the thumb handle 60.

Similarly, the support leg 14*c* may include the groove 12*c* which may latch to a surface, such as the cup 40 in FIG. 2.

Additionally, the toothbrush 102 includes a bristle cover 50 which may slide into the surfaces surface 21 and surface 24 through the groove track 51 and may latch with a retention ball 53 to snap the bristle cover 50 in place. The bristle cover 50 may be used to cover the bristles 30.

The toothbrush 102 with the bristle cover 50 may be offered in action figures, sport figures or teams, etc.

According to embodiments, the toothbrushes may house a music chip which may play approximately two minutes when the unibody support leg unibody support leg 14 or the other support legs are retracted into a handle, such as to support the American Dental Association recommendation of a two minute brushing time. The handles may glow in the dark, may include a slide out thermometer, and may house a flashing light chip to flash when the unibody support leg 14 or other support legs are retracted; the flashing lights may be turned over via a push of a thumbnail or the like on a switch.

Figure 11:
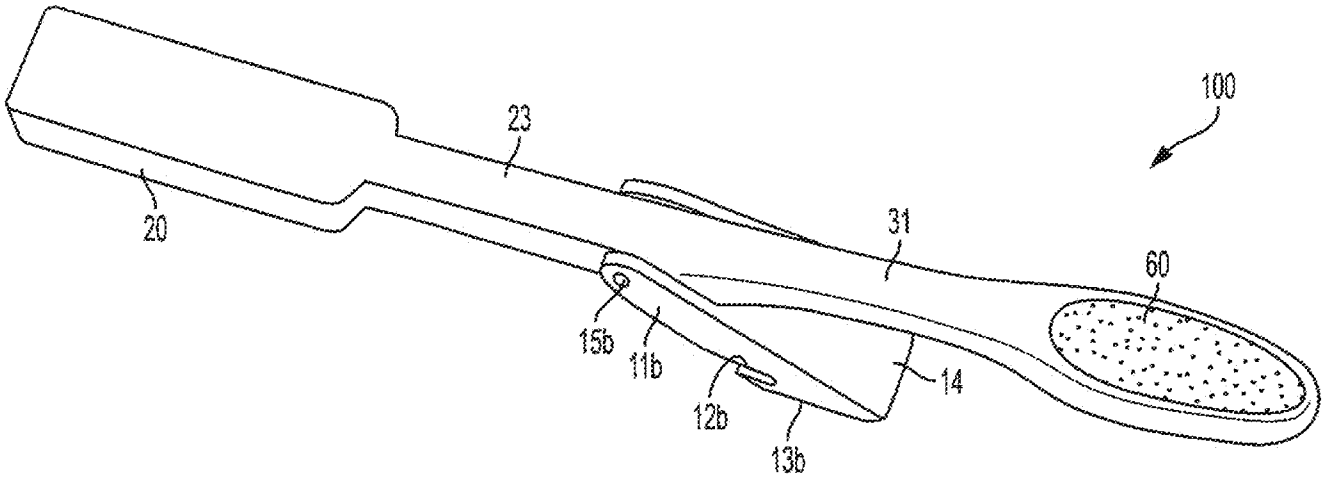

FIG. 11 illustrates the toothbrush 100 with a tongue scrubber 60 attached opposite to the bristles 30 shown in FIG. 1.

Figure 12:
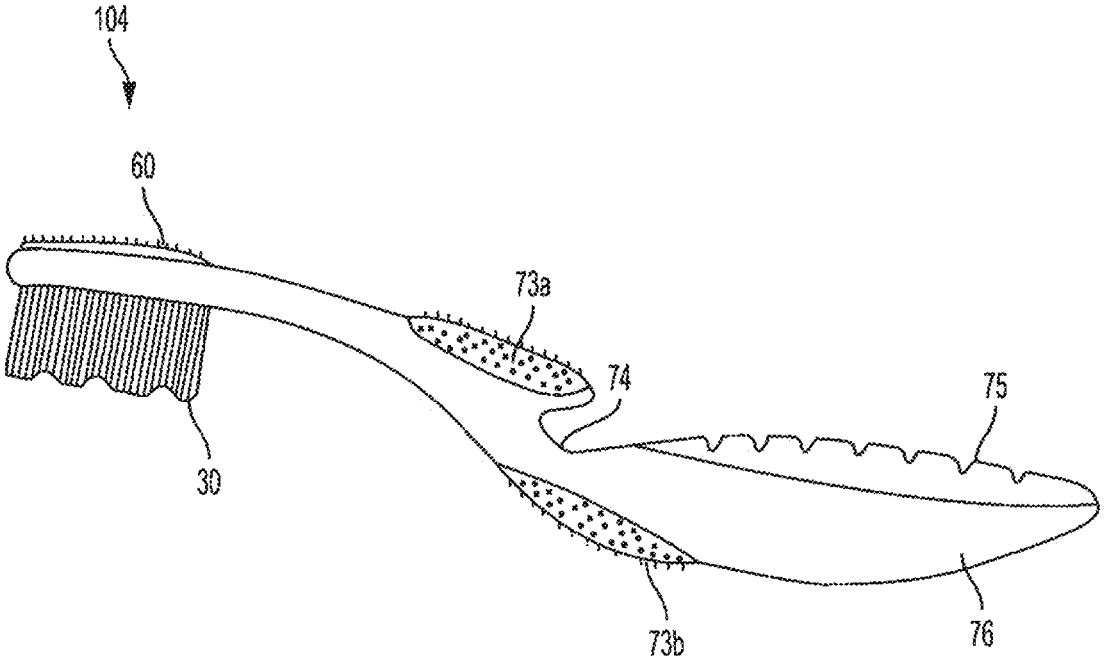

FIG. 12 illustrates a toothbrush 104 including a tongue scrubber 60, bristles 30, finger grips 73, a grip 75 such as rubber, and a bottom portion 76. The bottom portion 76 may act as a counter balance when the toothbrush 104 is hooked onto a cup, such as by the groove 74. Similarly to FIG. 2, in this configuration of FIG. 12, the bristles 30 of the toothbrush 104 remain in a state in which increased airflow may be maintained while also extending the bristles 30 away from the cup 40 such that, for example, other toothbrushes with similar or alternate configurations may also be arranged. That is, the bristles 30 of the toothbrush 104 would be maintained away from other bristles of other toothbrushes via a curvature of the toothbrush 104 and action of the bottom portion 76 with respect to the cup 40.

Figure 13:
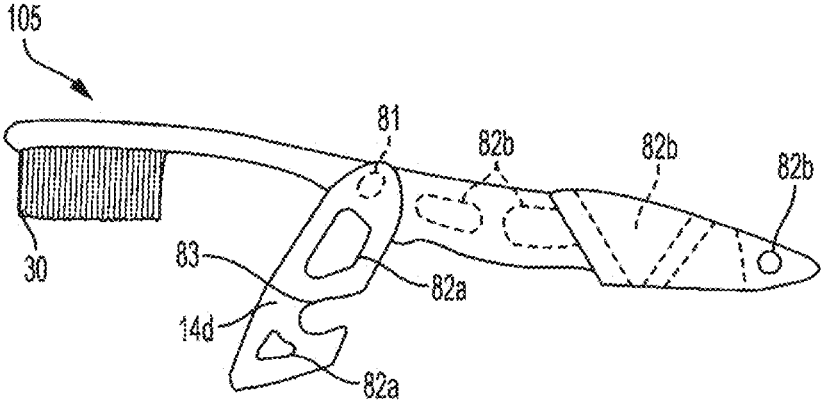

FIG. 13 illustrates a toothbrush 105 including bristles 72 and a support leg 14*d*. The support leg 14*d* may be a unibody support leg as in FIG. 1 or multi-body support legs as in FIG. 6. The support leg 14*d* may include a hook 83, similar to the other embodiments, and may also include hollow portions 82*a* to reduce material. Similarly, the body of the toothbrush 105 may also include hollow cavities 82*b* and may be made out of bamboo. Such reduction in material and use of bamboo may represent a zero ecological footprint and may thus prevent 50 million pounds of non-biodegradable plastic thrown into landfills annually. Such hollow cavity embodiments may save approximately handle 20 million pounds of non-biodegradable waste per year.

Figure 14:
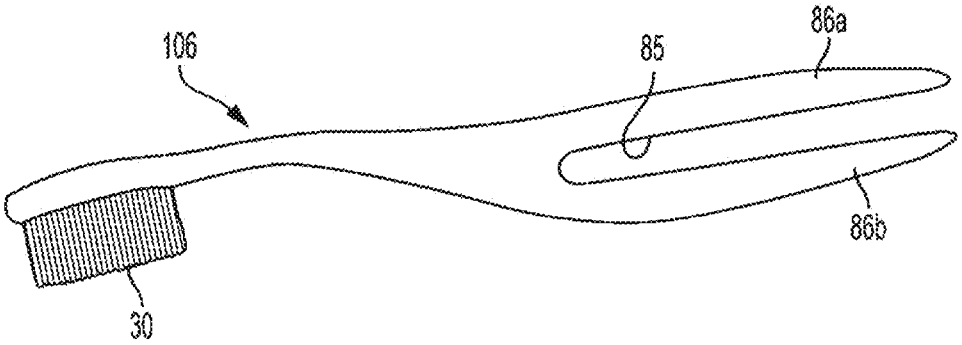

FIG. 14 illustrates a unibody support leg 14 illustrates a toothbrush 106 having bristles 30 and a slot 85 in the handle of the toothbrush. The slot 85 can be slid down onto a side of a cup, such as in FIG. 2, thus keeping toothbrushes from touching. The slot 85 grips 86*a* and 86*b* grip outside and insides of the cup, thereby keeping the bristles 30 upright to dry. The bristles 30 may face inward or outward on the cup.

Figure 15:
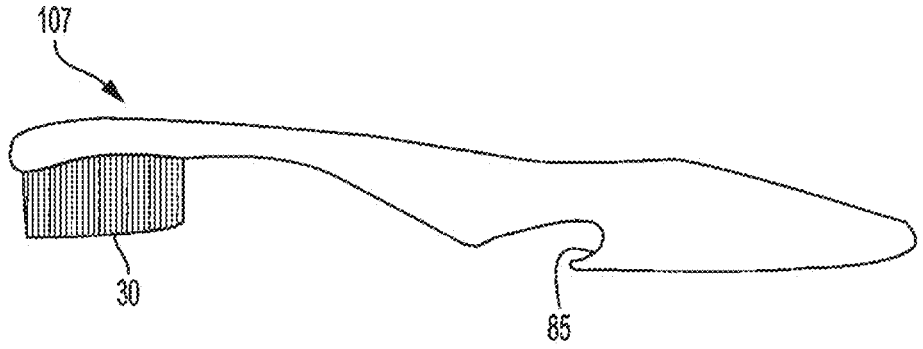

FIG. 15 illustrates a toothbrush 107 including bristles 30 and a hanging hook 85 on a front lower portion of a handle. The toothbrush 107 may be hung from the hanging hook 85 by which an airflow to the bristles 30 may be improved.

Figure 16:
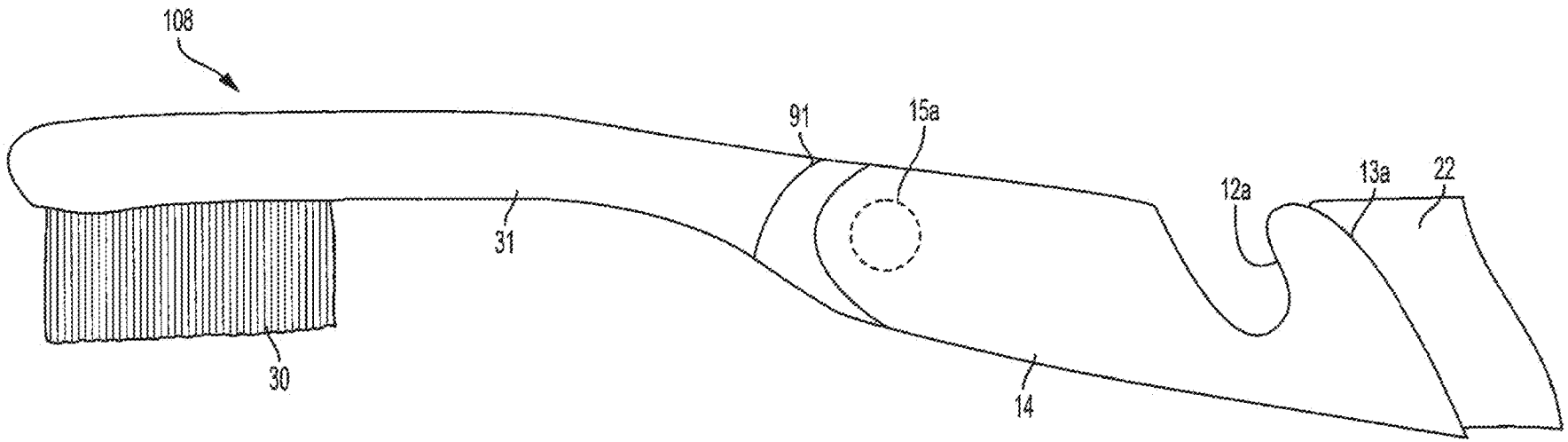

FIG. 16 illustrates a toothbrush 108, which may be substantially similar to any of the toothbrush 100 of FIG. 1 and the toothbrush 101 of FIG. 6 except that a front stopper 91 is provided so that engagement of the support leg 14 may be improved during attachment. That is, the front stopper 91 may help guide the support leg 14 into alignment via the attachment 15*a*.

Figure 17A:
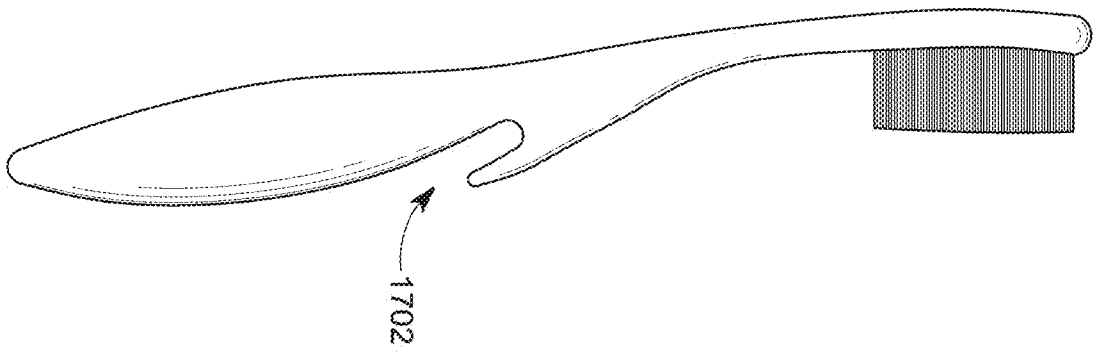
FIGS. 17A-17C show a toothbrush embodiment having a hook or groove formed integrally with the body of the toothbrush.
Figure 17B:
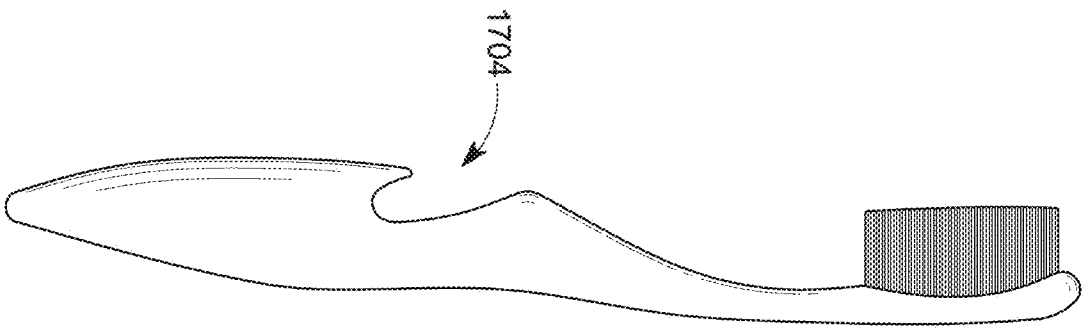
Figure 17C:
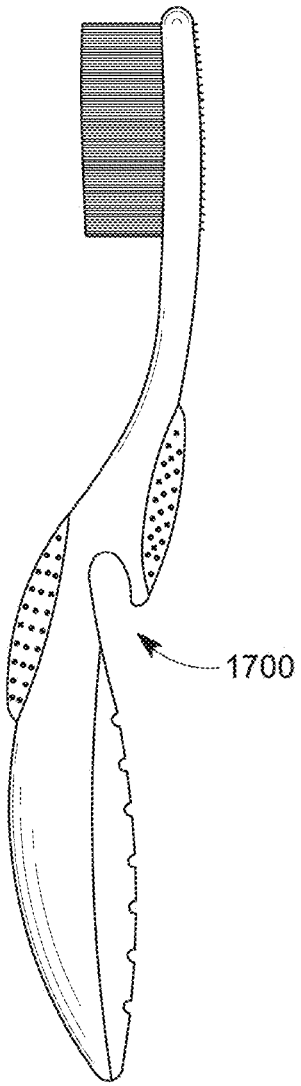

FIGS. 17A-17C illustrate various embodiments with hooks formed integrally in the body of the toothbrush, i.e., a unibody toothbrush with bristles and handle. More specifically, these three versions have a hanging hook formed onto the front of handle, or toothbrush body, which are useable to hang the toothbrush upright facing inward into a cup or other object. For example, FIG. 17C depicts an embodiment where a hanging hook 1700 is formed onto a back of the handle in order to enable the toothbrush user to hang the toothbrush facing upright and outward of a cup. Alternatively, the hanging hook can be formed on the front of the handle as shown in either FIG. 17A or 17B in either a non-inverted position 1702 or inverted position 1704, respectively, to enable the toothbrush to be hung bristle end up outside the cup or bristle end down outside of the cup, respectively.

Figure 18A:
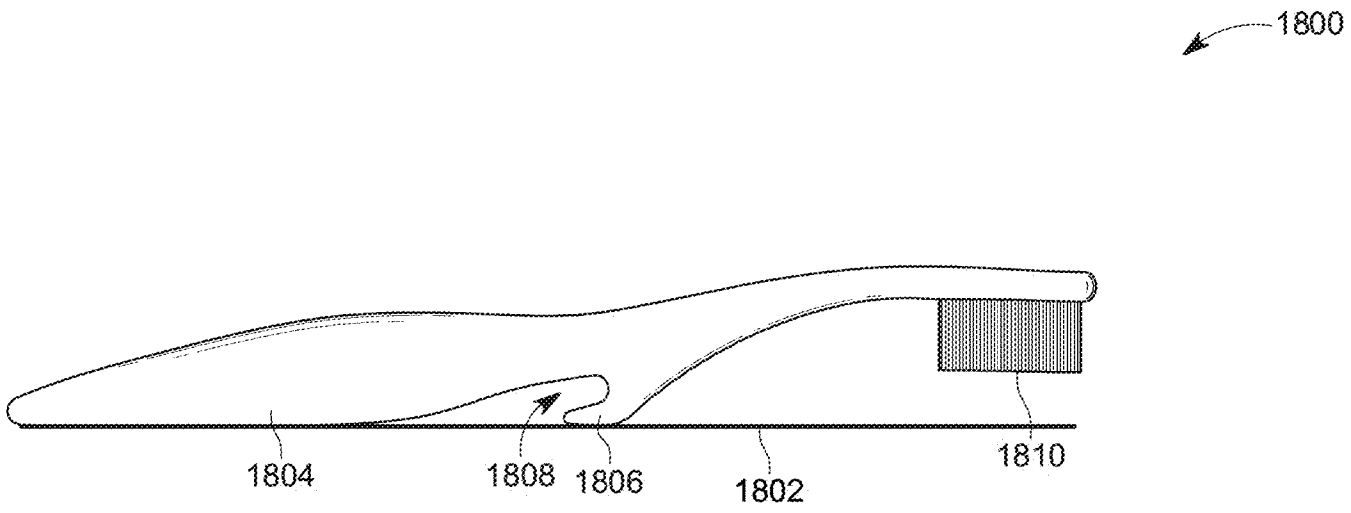
FIGS. 18A and 18B show a side view and a partial bottom view of a toothbrush according to another embodiment.
Figure 18B:
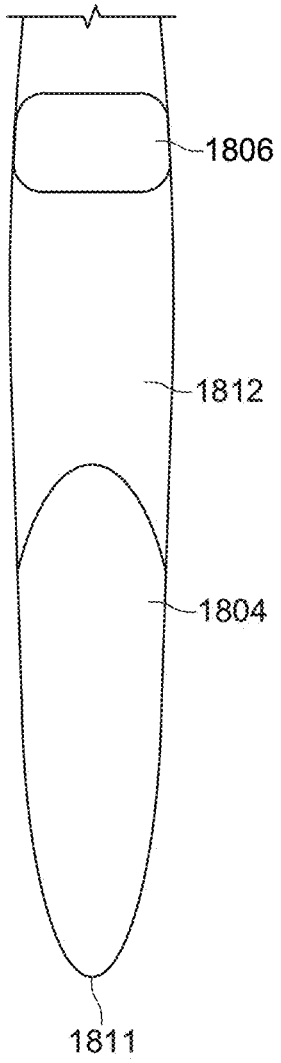

FIGS. 18A and 18B depict a toothbrush according to another embodiment. In this embodiment, the toothbrush 1800 is able to rest on a flat surface 1802 by virtue of having two flat and coplanar surfaces disposed on a bottom of the toothbrush 1800. More specifically, the toothbrush 1800 has a first flat surface 1804 disposed on the bottom surface of the handle portion of the toothbrush 1800 and a second flat surface disposed on the bottom surface 1806 of the hook portion of the toothbrush which is created by groove 1808. In this embodiment the first flat surface 1804 extends from an end 1811 of the toothbrush 1800 opposite the bristles 1810 up to a point 1812 where the groove begins to form the opening 1808 that creates the hook, and the second flat surface 1806 is created from the surface area of the hook which faces surface 1802. However those skilled in the art will recognize that these two flat surfaces can be made to be larger or smaller than shown. The two flat surfaces 1804 and 1806 should be coplanar or substantially coplanar so that they enable toothbrush 1800 to rest on surface 1802 such that the bristles 1810 do not touch surface 1802. Moreover the handle portion associated with the first flat surface 1804 should be sufficiently heavy (weighted) such that the bristle portion 1810 doesn't tip over onto surface 1802 when placed in the position shown in FIG. 18A.

Figure 19A:
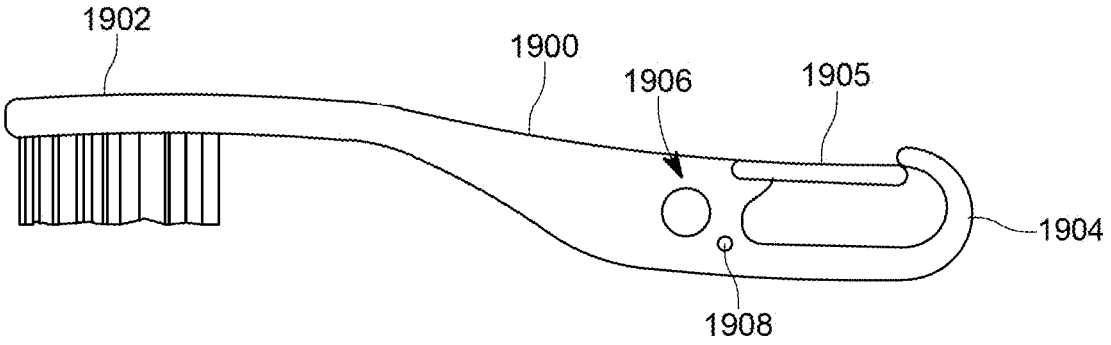
FIGS. 19A-19E illustrate a foldable toothbrush according to another embodiment.
Figure 19B:
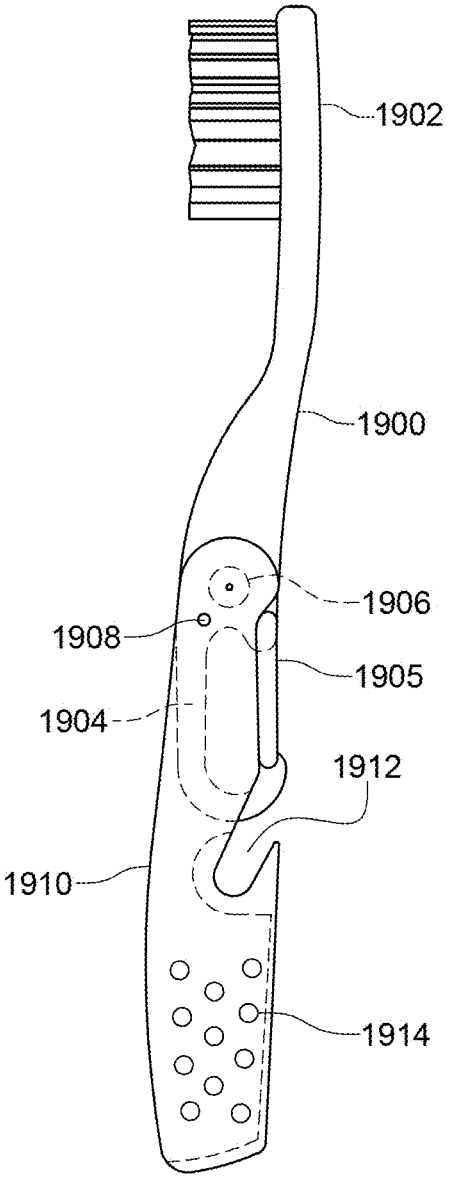
Figure 19C:
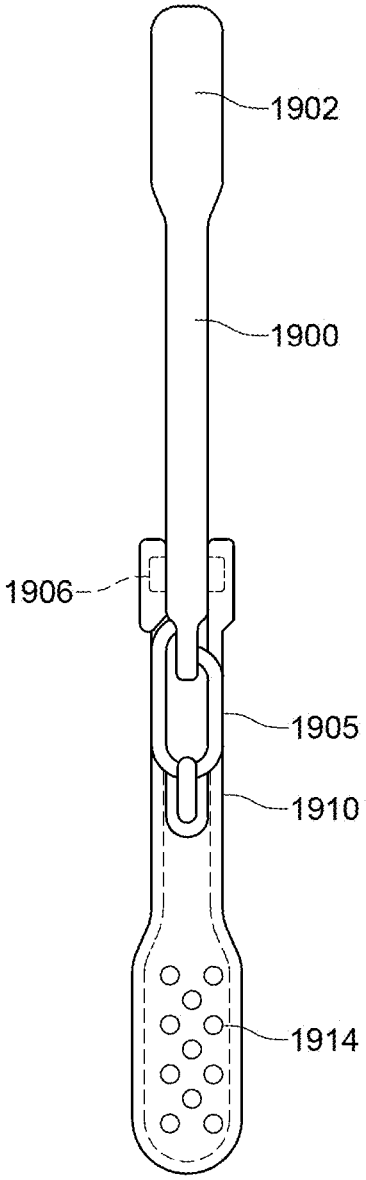
Figure 19D:
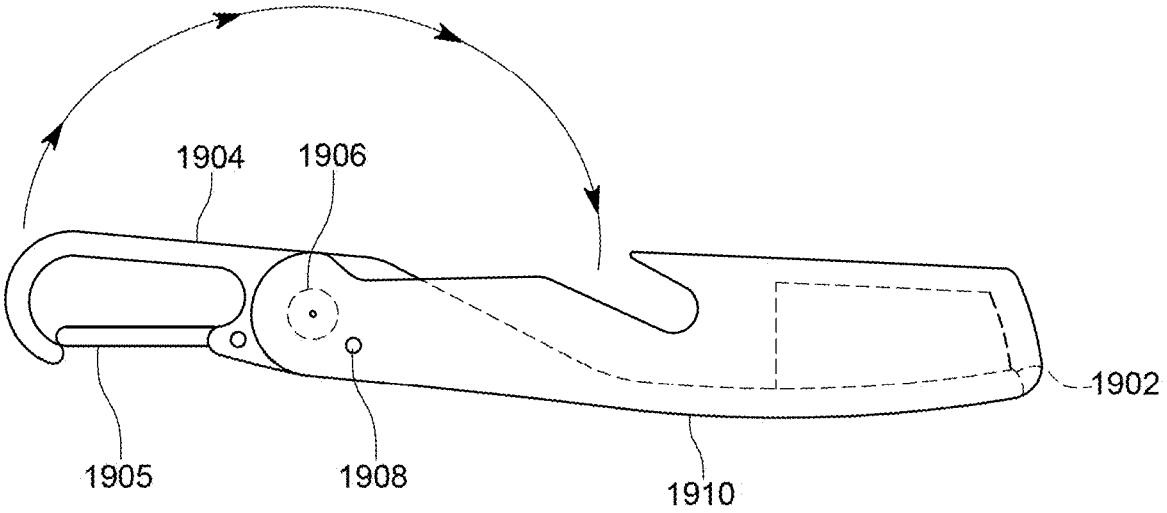
Figure 19E:
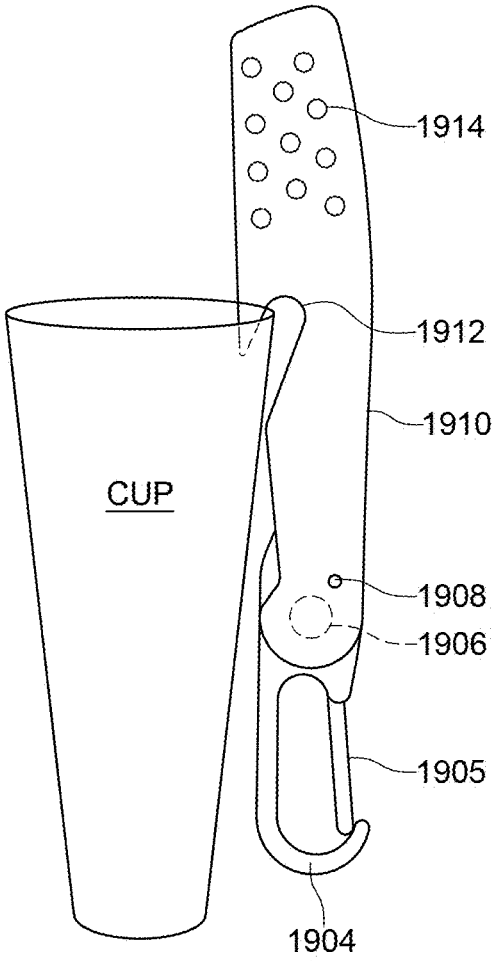

FIGS. 19A-19E depict another embodiment of a two-piece tactical folding toothbrush. The toothbrush/carabiner piece 1900 is illustrated in FIG. 19A. Toothbrush/carabiner piece 1900 includes a bristle head 1902 on one end and a carabiner clip 1904 on the other end with, for example, 3/16 inch snap in cleats above the carabiner clip 1904, 1905. The carabiner clip 1904, 1905 enables, for example, the folding toothbrush to be clipped to a backpack or loop on jeans and includes a carabiner clip portion 1904 and a carabiner spring portion 1905. FIG. 19A also depicts a pivot pin 1906 which enables the piece 1900 to be rotated/folded into the handle piece 1910 as described below. Also shown in FIG. 19A is a ball detent 1908 which operates to keep the bristle head portion 1902 of the toothbrush/carabiner piece 1900 from opening when the toothbrush is hanging in the closed position (e.g., as shown in FIG. 19E and described below).

FIG. 19B shows a side view of the folding toothbrush pieces 1900 and 1910 assembled in the open position (unfolded), i.e., a position in which the bristle head 1902 extends away from the handle piece 1910. The handle piece 1910 can be fabricated plastic and has a cavity shaped to fit and house the toothbrush/carabiner piece 1900 as will be described below. The handle piece 1910 also includes a hang hook 1912 which enables the folding toothbrush to be hung on a cup rim and includes vent holes which enables the bristle head 1902 to vent when the folding toothbrush is in its closed or folded position. The hang hook 1912 can be shaped to also operate as a bottle opener as seen in FIG. 19B. FIG. 19C is a rear view of the folding toothbrush again in its open position. The carabiner spring 1905 rests on the frame of the handle 1910 when the folding toothbrush is in the open position as seen in FIG. 19C, while the carabiner clip 1904 rests in a slot in the handle 1910, and the toothbrush user can put his or her finger on the carabiner spring 1905 to press it against the handle while the toothbrush is in use. In both FIGS. 19B and 19C the dotted lines surrounding the vent holes 1914 depict the presence of the cavity within the handle piece 1910 where the bristle head 1902 rests when in the closed position.

FIG. 19D shows the folding toothbrush in the closed position, i.e., where the bristle head 1902 rests in the cavity 1916 in the handle piece 1910. Arrows shows how the toothbrush/carabiner piece 1900 can be rotated around pivot pin 1906 to change the folding toothbrush from the closed position to the open position. The pivot pin 1906 can snap into a cavity in the handle piece 1910. FIG. 19F depicts the folding toothbrush in the closed position hanging on the rim of a cup using hang hook 1912.

From the foregoing various advantages and benefits associated with a folding toothbrush in accordance with these embodiments will be appreciated. For example, when in the closed position, the bristles on bristle head 1902 are covered/protected on three sides. The handle portion which houses the bristles are ventilated, e.g., on all three sides of the handle. When the folding toothbrush is opened, the carabiner clip 1904 vanishes into a slot in the handle but the carabiner spring 1905 acts as a stopper to prevent the carabiner clip 1904 from rotating through the handle. The toothbrush/carabiner piece 1900 can snap into the handle piece 1910 by virtue of angled cleats in the toothbrush/carabiner piece 1900 and a corresponding round cavity in the handle piece 1910.

Although the embodiments described herein are shown for manual toothbrushes, those skilled in the art will appreciate that the toothbrush body embodiments described herein are equally applicable to electrical toothbrushes where the bristles oscillate or reciprocate under electrical power from a battery or power cord.

Although the inventive concept has been described above with respect to the various example embodiments, it is noted that there can be a variety of permutations and modifications of the described features by those who are familiar with this field, without departing from the technical ideas and scope of the features, which shall be defined by the appended claims.

Further, while this specification contains many features, the features should not all be construed as limitations on the scope of the disclosure or the appended claims.

Certain features described in the context of separate embodiments can also be implemented in combination. Conversely, various features described in the context of a single embodiment can also be implemented in multiple embodiments separately or in any suitable sub-combination.

Although the drawings describe operations in a specific order and/or show specific arrangements of components, one should not interpret that such specific order and/or arrangements are limited, or that all the operations performed and the components disclosed are needed to obtain a desired result. Accordingly, other implementations are within the scope of the following claims.

What is claimed is:

1. A toothbrush comprising:

a toothbrush portion having a bristle end and a carabiner clip end;

a handle portion;

a hang hook formed in the handle portion;

wherein the toothbrush portion includes a pivot pin which is rotatably connectable to the handle portion such that the toothbrush portion can be rotated between a first position where the bristle end extends from the handle portion and a second position where the carabiner clip end extends from the handle portion;

a cavity formed in the handle portion configured to at least partially enclose the bristle end of the toothbrush portion when the toothbrush portion is in the second position;

wherein the cavity includes vent holes;

wherein the carabiner clip end includes a hook portion and a spring portion;

a slot formed in the handle portion configured to receive the hook portion of the carabiner clip end when the toothbrush portion is in the first position; and wherein the spring portion of the carabiner clip end abuts a surface on the handle portion when the toothbrush is in the first position.

2. The toothbrush of claim 1, further comprising:

a hang hook formed in the handle portion.

3. The toothbrush of claim 2, wherein the hang hook is configured to operate as a bottle opener.

4. The toothbrush of claim 1, further comprising:

a cavity formed in the handle portion configured to at least partially enclose the bristle end of the toothbrush portion when the toothbrush portion is in the second position.

5. The toothbrush of claim 4, wherein the cavity includes vent holes.

6. The toothbrush of claim 1, further comprising:

wherein the carabiner clip end includes a hook portion and a spring portion; and a slot formed in the handle portion configured to receive the hook portion of the carabiner clip end when the toothbrush portion is in the first position.

7. The toothbrush of claim 6, wherein the spring portion of the carabiner clip end abuts a surface on the handle portion when the toothbrush portion is in the first position.

8. The toothbrush of claim 7, wherein the toothbrush is configured to enable a user to press the spring portion of the carabiner clip end against the surface on the handle portion when the toothbrush portion is in the first position to keep the toothbrush portion substantially nonrotatable about the pivot pin while in use.

9. A toothbrush comprising:

a toothbrush portion having a bristle end and a carabiner clip end; and a handle portion;

wherein the toothbrush portion includes a pivot pin which is rotatably connectable to the handle portion such that the toothbrush portion can be rotated between a first position where the bristle end extends from the handle portion and a second position where the carabiner clip end extends from the handle portion.

* * * * *